US010603951B2

(12) United States Patent
Skinner

(10) Patent No.: US 10,603,951 B2
(45) Date of Patent: Mar. 31, 2020

(54) PIXEL CHALK ART

(71) Applicant: CRAYOLA, LLC, Easton, PA (US)

(72) Inventor: Craig John Skinner, Nazareth, PA (US)

(73) Assignee: Crayola LLC, Easton, PA (US)

( * ) Notice: Subject to any disclaimer, the term of this patent is extended or adjusted under 35 U.S.C. 154(b) by 204 days.

(21) Appl. No.: 15/984,849

(22) Filed: May 21, 2018

(65) Prior Publication Data

US 2018/0339544 A1 Nov. 29, 2018

Related U.S. Application Data

(60) Provisional application No. 62/509,829, filed on May 23, 2017.

(51) Int. Cl.
*B43L 13/20* (2006.01)
*A63H 33/00* (2006.01)
*B44D 2/00* (2006.01)

(52) U.S. Cl.
CPC ..... *B43L 13/205* (2013.01); *A63H 33/00* (2013.01); *B44D 2/007* (2013.01)

(58) Field of Classification Search
CPC ..... B43L 13/205
USPC ..... 33/563, 565
See application file for complete search history.

(56) References Cited

U.S. PATENT DOCUMENTS

D141,882 S * 7/1945 Matson ..... B43L 13/205 D10/62
2,525,837 A * 10/1950 Simplair ..... G06K 19/00 33/563
2,713,205 A * 7/1955 Nielsen ..... B43L 13/205 33/479
3,037,293 A * 6/1962 Yost ..... B43L 11/06 33/565
5,058,285 A * 10/1991 Morita ..... B43L 13/205 33/447
6,341,430 B1 * 1/2002 Carstens ..... G05D 1/0234 33/563
8,186,072 B1 * 5/2012 Nethery ..... D05B 97/12 33/11
8,499,470 B1 * 8/2013 Hilton ..... B43L 7/10 33/474
2008/0040942 A1 * 2/2008 Eales ..... G01D 5/34 33/707
2010/0207945 A1 * 8/2010 Kirsch ..... G09F 9/37 345/428

(Continued)

*Primary Examiner* — George B Bennett
(74) *Attorney, Agent, or Firm* — Shook, Hardy & Bacon, L.L.P.

(57) ABSTRACT

The present invention is directed to a device, a system and a kit for creating pixel artwork. A device may include a stencil for sidewalk chalk that has a planar body and a plurality of apertures. The stencil may be repositionable on a surface of a substrate and may guide application of a marking device to generate a pixelated grid on the surface of the substrate positioned below the stencil. The pixelated grid may be formed by multiple pixel components that correspond to the stencil. Both a system for creating pixel art and a pixel art kit may include a sidewalk chalk stencil, a plurality of marking devices, and either a pixel assignment or a first instruction. The pixel assignment and the instruction may direct application of the plurality of marking devices to create a pixel artwork of substrate.

20 Claims, 2 Drawing Sheets

(56) References Cited

U.S. PATENT DOCUMENTS

| | | | | |
|---|---|---|---|---|
| 2013/0212891 | A1* | 8/2013 | Mariller | G01B 5/012 33/503 |
| 2015/0314636 | A1* | 11/2015 | Conner | B43L 13/201 33/565 |
| 2018/0304642 | A1* | 10/2018 | Skinner | B41F 15/34 |
| 2019/0023059 | A1* | 1/2019 | McBride, Jr. | B43L 13/205 |

* cited by examiner

PIXEL CHALK ART

CROSS REFERENCE TO RELATED APPLICATION

This application is a nonprovisional of and claims priority to U.S. Provisional Patent Application No. 62/509,829 entitled "Pixel Chalk Art," filed May 23, 2017, the entirety of which is incorporated by reference herein.

SUMMARY

Embodiments of the invention are defined by the claims below, not this summary. A high-level overview of various aspects of the invention are provided here for that reason, to provide an overview of the disclosure, and to introduce a selection of concepts that are further described below in the detailed-description section below. This summary is not intended to identify key features or essential features of the claimed subject matter, nor is it intended to be used as an aid in isolation to determine the scope of the claimed subject matter.

In brief and at a high level, this disclosure describes, among other things, a device, system, and kit for creating a pixel artwork on a substrate, which may include pixelated components that visually contrast to collectively form a pixelated image. Embodiments of the invention include a stencil for generating a pixelated grid on a surface of a substrate. The stencil may be repositionable, include a plurality of apertures, and may guide application of a marking device to a surface of a substrate. The stencil may be used with the marking device to generate a pixelated grid on the substrate's surface by repositioning the stencil atop the substrate and marking the surface of the substrate through the plurality of apertures. The pixelated grid may include multiple pixel components that may be filled-in or colored to create a pixel artwork.

Embodiments of the invention include a stencil for sidewalk chalk that includes a planar body and a plurality of apertures that extend through the planar body. The plurality of apertures may have an orientation that includes a shape, which may be arranged to form a cube, hexagon, or staggered brick orientation. Moreover, the stencil may be configured to guide application of markings on a surface of a substrate to generate a pixelated grid on the surface.

Embodiments of a system for creating pixel artwork may include a sidewalk chalk stencil, an instruction, and a plurality of marking devices. The sidewalk chalk stencil may be configured for generating a pixelated grid formed of a plurality of pixel components on a surface of a substrate. Moreover, the instruction may be configured to designate a position value to each pixel component of the plurality of pixel components based on a location of the each pixel component within the pixelated grid, which may be utilized to fill-in or apply multiple, associated colored markings to the surface of the substrate to create a pixel artwork. Additionally, the plurality of marking devices may be configured to transfer one or more markings to the surface, may include a color element, and may be associated with one or more position values.

Embodiments of the invention also include providing a pixel art kit that includes a sidewalk chalk stencil and a plurality of marking devices. The sidewalk chalk stencil may include a plurality of apertures that have an orientation and may be repositionable on a surface of a substrate. The plurality of marking devices may be configured to transfer a marking device onto the surface of the substrate and thus, may be used to generate a pixelated grid and pixel artwork thereon. In additional aspects, the pixel art kit may include an instruction that may be configured to direct application of one or more marking devices to designated areas of the pixelated grid to create pixel artwork.

DESCRIPTION OF THE DRAWINGS

Illustrative embodiments of the invention are described in detail below with reference to the attached drawing figures, and wherein.

DETAILED DESCRIPTION

Figure 1:
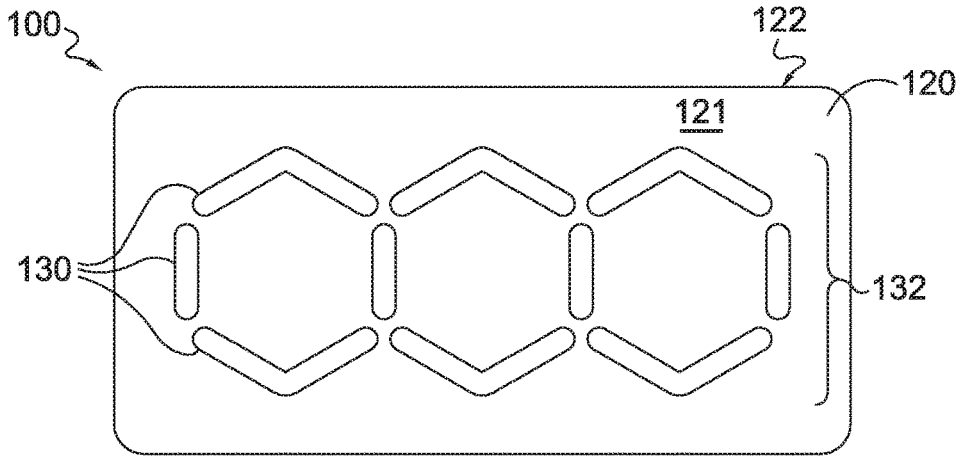
FIG. 1 is a top elevation view of a first exemplary stencil for pixel art, in accordance with an embodiment of the present invention.

The subject matter of embodiments of the invention is described with specificity herein to meet statutory requirements. But the description itself is not intended to necessarily limit the scope of claims. Rather, the claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly described.

Embodiments of the invention include, among other things, a device, system, and kit for creating a pixel artwork on a substrate, which may include a pixelated grid formed by multiple, individual pixel components that may be filled-in or colored. In an exemplary embodiment, a stencil for sidewalk chalk may include a planar body presenting a first surface and an opposite second surface and a plurality of apertures that extend through the planar body. The plurality of apertures may comprise an orientation including a cube arrangement, hexagon arrangement, staggered brick arrangement, and the like.

Embodiments of a system for creating pixel artwork may include a sidewalk chalk stencil, an instruction, and a plurality of marking devices. The sidewalk chalk stencil may be configured for generating a pixelated grid formed of a plurality of pixel components on a surface of a substrate. In some aspects, it is contemplated that the stencil for sidewalk chalk may be included in the system. Moreover, the instruction may be configured to designate a position value to each pixel component of the plurality of pixel components based on a location of the each pixel component within the pixelated grid, which may be utilized to fill-in or apply multiple, associated colored markings to the surface of the substrate to create a pixel artwork. Additionally, the plurality of marking devices may be configured to transfer one or more markings to the surface, may include one or more color elements, and may be associated with one or more position values.

Embodiments of the invention also include providing a pixel art kit that includes a sidewalk chalk stencil and a plurality of marking devices. The sidewalk chalk stencil may include a plurality of apertures that have an orientation and may be repositionable on a surface of a substrate. It is also contemplated that the stencil for sidewalk chalk may be included in the pixel art kit. The plurality of marking devices may be configured to transfer a marking device onto the surface of the substrate and thus, may be used to generate a pixelated grid and pixel artwork thereon. In additional aspects, the pixel art kit may include an instruction that may be configured to direct application of one or more marking devices to designated areas of the pixelated grid to create pixel artwork.

Exemplary aspects herein contemplate that the stencil may be configured to generate a pixelated grid on a surface of a substrate. At a high level, the stencil may be utilized with a marking device to create markings on the surface of the substrate, and these markings may correspond to an orientation of the plurality apertures and define individual pixel components that form the pixelated grid. Generally, these aspects contemplate that the stencil may be positioned atop the substrate, and a marking device may create markings on areas of the surface of the substrate that are contactable through the stencil via the plurality of apertures. The stencil may then be repositioned atop a different location of the substrate, and the marking device may create additional markings on different areas of the surface that are contactable through the stencil via the plurality of apertures. The markings created on the surface of the substrate may define borders of multiple, individual pixel components that collectively form the pixelated grid.

In more detailed aspects, the stencil may be configured to be positionable on a substrate such that the second surface may be adjacent and proximate the surface of the substrate, and it is contemplated that such positioning may cause the second surface to be contiguous with the surface of the substrate. At this position, the plurality of apertures present openings that expose the surface of the substrate, which may permit an object, such as a marking device, to traverse through the stencil to contact the surface of the substrate. Further, the planar body may be solid and may be configured to form a barrier over the surface of the substrate, and therefore, the surface of the substrate may only be contacted at areas corresponding to the plurality of apertures.

In addition, it is contemplated that the stencil may be configured to guide application of a marking device on the surface of the substrate, and it is also contemplated that the marking device may be configured to create multiple markings on the surface of the substrate. The stencil may be positioned on the substrate and may be configured to maintain this position while the marking device is being used with the stencil. The marking device may be applied by extending the marking device through the plurality of apertures to contact the substrate in a manner that creates a marking on the first surface of the substrate. Moreover, the marking device may be repeatedly applied such that markings are created at areas of the surface that are exposed by the plurality of apertures and are not created at areas of the surface that are covered by the planar body of the stencil. As a result and upon removal of the stencil, the surface of the substrate may include multiple markings that correspond to the plurality of apertures and may be unmarked at an area corresponding to the planar body. Further, it is contemplated that the stencil may be repositioned to a different location on the substrate, and the marking device may be applied in a same manner to create more markings at different areas of the surface.

In additional aspects, it is contemplated that the stencil may be utilized in connection with the marking device to generate a pixelated grid formed by multiple, individual pixel components that have an orientation corresponding to the plurality of apertures. Generally, the plurality of apertures may have an orientation that may be included in the stencil to form an arrangement, such as a cube arrangement, a hexagon arrangement, a staggered brick arrangement, or the like. As discussed, the marking device may create markings on the surface of the substrate that correspond to the plurality of apertures, and thus, these markings may also have a same arrangement as the plurality of apertures. Consequently, the markings on the surface of the substrate may define borders of the individual pixel components, and the stencil may be repositioned on the substrate such that the marking device may create more markings on the surface that define borders of additional, individual pixel components. Collectively, the individual pixel components form the pixelated grid. Further, the stencil may be repositioned such that the multiple, individual pixel components may be linearly aligned in rows and columns, and the stencil may be continually repositioned until a sufficient amount of individual pixel components have been generated to form a pixelated grid of a desired size. These aspects, as well as other related aspects, are further illustrated and discussed below.

Aspects described herein contemplate that the stencil may be configured such that a variety of marking devices may be implemented to generate a pixelated grid on multiple surfaces, and it is further contemplated that a marking device may include any marking device known to those having ordinary skill in the art so long as the marking device is capable of creating a marking on the substrate. Similarly, the substrate may include any suitable substrate that is capable of receiving a marking from the marking device.

In some aspects, a stencil may be configured for generating a pixelated grid by implementing a chalk marking device such as sidewalk chalk, chalk stick, chalk bag, and/or chalk powder. These aspects contemplate that the pixelated grid may be formed on a substrate capable of receiving a marking from the chalk marking device including, but not limited to, a sidewalk, driveway, chalk board surface, chalk wall, chalk board, and the like. As such, the stencil and components thereof may be configured such that the chalk marking device may create a marking on the surface of the substrate positioned below the stencil at areas exposed by the plurality of apertures. Additional marking devices, other than chalk-type marking devices, may be utilized to generating the pixelated grids described herein.

Further aspects herein contemplate that a stencil may be constructed from a plastic-type material capable of providing a stencil with the functionality described herein.

Figure 2:
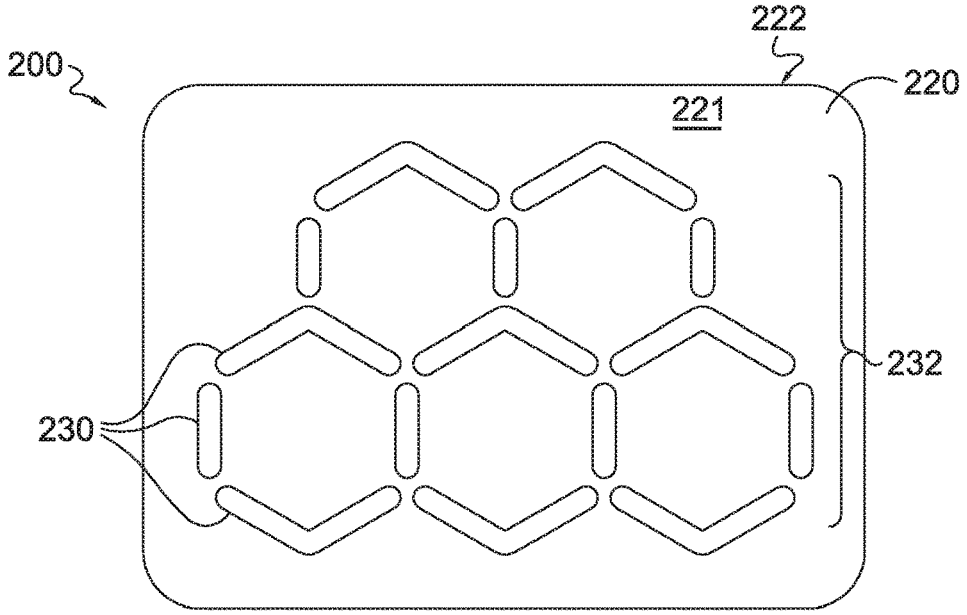
FIG. 2 is a top elevation view of a second exemplary stencil for pixel art, in accordance with an embodiment of the present invention.
Figure 3:
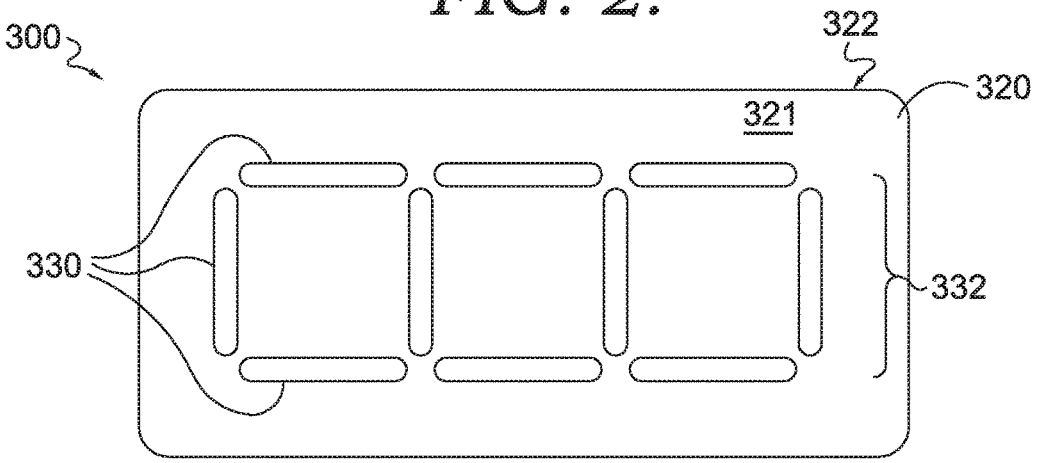
FIG. 3 is a top elevation view of a third exemplary stencil for pixel art, in accordance with an embodiment of the present invention.

Accordingly, exemplary embodiments of a stencil for pixel art are shown in FIGS. 1-3, and as can be seen, each exemplary stencil depicts a different orientation of a plurality of apertures, but otherwise, the exemplary stencils include similar features. Beginning with FIG. 1, which depicts a top elevation view, a stencil 100 may include a planar body 120 that presents a first surface 121 and an opposite second surface 122. The planar body 120 may form a general structure of the stencil 100, and the stencil 100 may have a substantially flat, planar structure such that the stencil 100 may be easily positioned atop a substrate. In addition, the stencil 100 may be a rectangular shape that may be defined by exterior edges of the planar body 120, and although not identified, the stencil 100 may take on a variety of shapes defined by multiple edges of the planar body 120 that may be linear or curvilinear.

Continuing with FIG. 1, the stencil 100 further includes a plurality of apertures 130 that may be positioned throughout the stencil 100 and may extend through the first surface 121 and the second surface 122 of the planar body 120. Thus, the plurality of apertures 130 may be configured to permit an object (e.g., a marking device) to traverse through the stencil 100 from a side proximate the first surface 121 to an opposite side proximate the second surface 122. In addition, the plurality of apertures 130 may include individual apertures of different shapes and/or sizes, and the plurality of apertures 130 may be arranged in the stencil 100 to form a pattern and/or an orientation. For instance, in the example shown in FIG. 1, the individual apertures may either be a straight, tubular shape or an angular, tubular shape, and each individual aperture may be arranged in the stencil 100 such that the plurality of apertures 130 have an orientation of a first hexagon arrangement 132. Moreover, the first hexagon arrangement 132 may include a single row of three hexagons with edges that are formed by four individual apertures of the plurality of apertures 130. However, the hexagonal arrangements provided in the stencil 100 are not limited to single rows containing three hexagons. Rather, embodiments of the invention contemplate any number of rows embodied in a single stencil, where each row may include a variable number of apertures forming a variety of shapes.

Turning now to FIG. 2, a stencil 200 is depicted from a top elevation view, and the stencil 200 may include some of the same components as the stencil 100. It is to be understood that any aspects of the stencil 100 that were previously discussed in connection with FIG. 1 are included in and applicable to the stencil 200 unless such aspects are described otherwise. As such, the stencil 200 also includes a planar body 220 that present a first surface 221 and an opposite second surface 222. Moreover, the planar body 220 forms an overall structure the stencil 200, and exterior edges of the planar body 220 define a shape of the stencil 200. In the example of FIG. 2, the stencil 200 has a substantially flat, planar structure and a rectangular shape (but is not limited to a rectangular shape). The stencil 200 also includes a plurality of apertures 230, which are also similar to the plurality of apertures 130 of the stencil 100, but the plurality of apertures 230 have a different orientation. As shown in FIG. 2, the plurality of apertures 230 have an orientation of a second hexagon arrangement 232. Moreover, the second hexagon arrangement 232 may include two rows of hexagons with edges that are formed by individual apertures of the plurality of apertures 230. A first row may include two hexagons and a second row may include three hexagons, and as depicted, the hexagons are aligned such that hexagons of the first row are offset with hexagons of the second row and vice versa. As previously mentioned, the number of rows and the number of shapes within the rows (e.g., hexagons) is not limited by the figures provided. Any number of rows and shapes are contemplated to be possible within the stencil 200.

With reference now to FIG. 3, a stencil 300 is depicted from a top elevation view, and as can be seen, the stencil 300 includes some of the same components as the stencils 100, 200. Thus, any aspects of the stencils 100, 200 that were previously discussed in connection with FIGS. 1 and 2 are included in and applicable to the stencil 300 unless such aspects are described otherwise. As such, the stencil 300 includes a planar body 320 presenting a first surface 321 and an opposite second surface 322, and the planar body 320 has a substantially flat, planar structure that may be imparted to the stencil 300. Moreover, the planar body 320 has exterior edges that define a shape of the stencil 300, which is depicted in this example as a rectangular shape. The stencil 300 further includes a plurality of apertures 330, which are also similar to the plurality of apertures 130, 230, but each aperture of the plurality of apertures 330 has a same linear, tubular shape and is arranged in the stencil 300 to form a different orientation. The plurality of apertures 330 have an orientation of a cube arrangement 332 that includes a single row of three squares with edges that are formed by four individual apertures of the plurality of apertures 330. As mentioned with respect to FIGS. 1 and 2, the number of rows and shapes therein are merely shown in the drawings for exemplary purposes and is not meant to limit the number of rows and shapes therein that are possible within the stencils.

Figure 4:
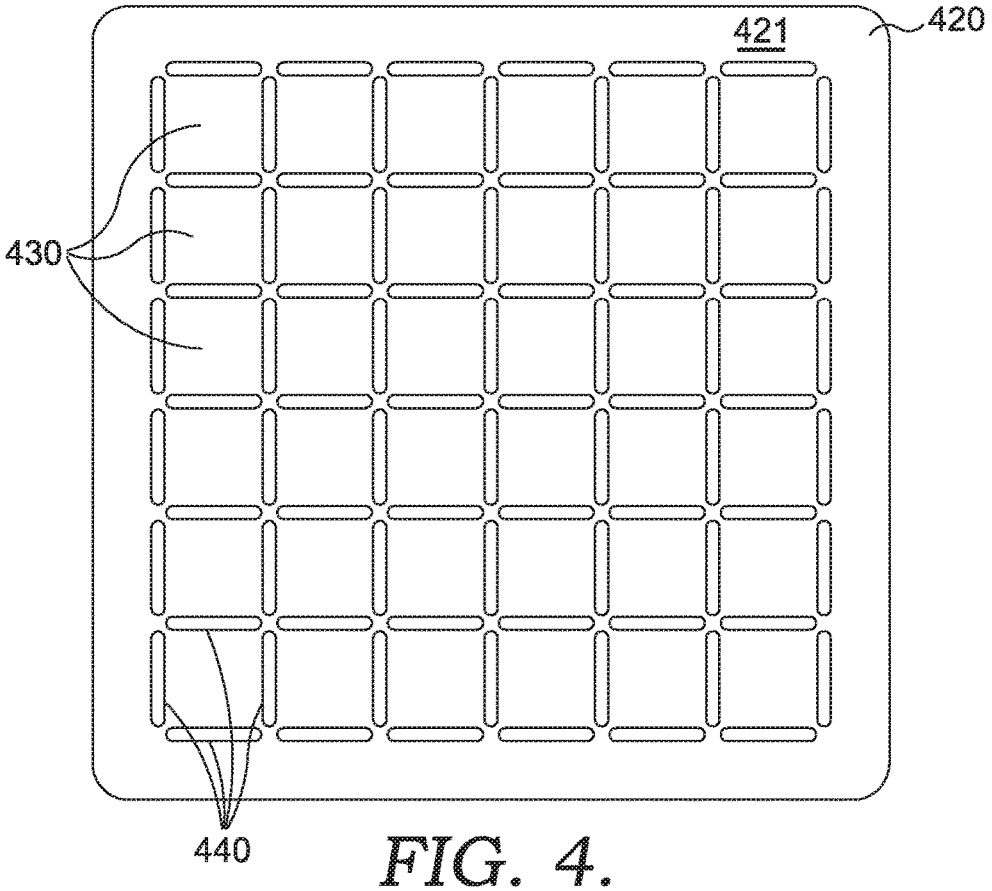
FIG. 4 depicts a top elevation view of a pixelated grid generated with the stencil of FIG. 3, in accordance with an embodiment of the present invention.

In FIG. 4, an exemplary pixelated grid on a surface of a substrate that was generated by the stencil 300 is depicted from a top elevation view. In this example, the pixelated grid may be generated on a surface 421 of a substrate 420, and the pixelated grid may be formed of multiple pixel components 430. In accordance with aspects herein, one or more markings 440 created by a marking device on the surface 421 may define a border (not identified) of each pixel component of the multiple pixel components 430. Further, the borders of the multiple pixel components 430 correspond to the cube orientation of 332 of the plurality of apertures 330 of the stencil 300, and collectively the borders define the pixelated grid. As such, each pixel component may be a same shape and arranged in the pixelated grid in linearly aligned rows and columns, and in this example, the pixelated grid includes a pattern of repeating squares.

Figure 5:
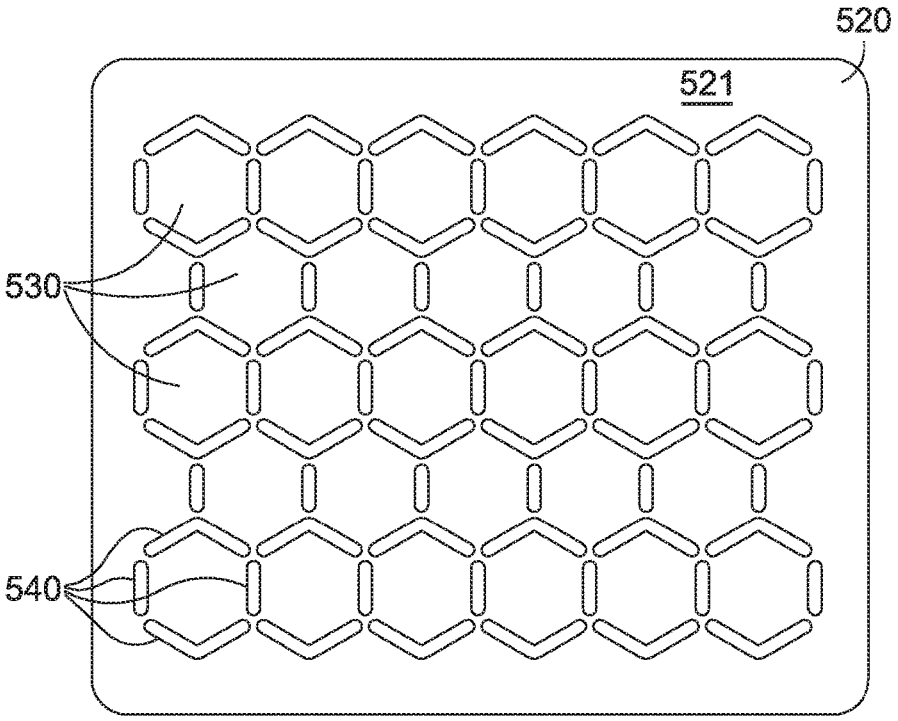
FIG. 5 depicts a top elevation view of a pixelated grid generated with the stencil of FIG. 1 or the stencil of FIG. 2, in accordance with an embodiment of the invention.

FIG. 5 depicts an exemplary pixelated grid from a top elevation view that was generated by the stencil 100 or the stencil 200. Like the pixelated grid of FIG. 4, the pixelated grid of FIG. 5 may be generated on a surface 521 of a substrate 520 and may be formed of multiple pixel components 530. Further, one or more markings 540 created on the surface 521 by a marking device may define a border (not identified) of each pixel component of the multiple pixel components 530. The borders of the multiple pixel components 530 correspond to the first hexagon arrangement 132 and the second hexagon arrangement 232 of the stencil 100 and the stencil 200, respectively. Collectively, the borders define the pixelated grid. Moreover, each pixel component may be a same shape and arranged in the pixelated grid in rows and columns, and in this example, the pixelated grid includes a "honeycomb" pattern.

In exemplary aspects and with reference to FIGS. 4 and 5, the multiple pixel components 430, 530 may comprise a plurality of position values that may be based on a location of the multiple pixel components in their respective pixelated grids. Moreover, the position values may be provided by an instruction that is configured to designate a position value to each pixel component and direct application of one or more marking devices. As such, the position values may also be associated with one or more marking devices such that one position value may correspond to one marking device, which may be indicated to a user by the instruction. Moreover, the instruction may further direct the user to apply the one or marking devices to the multiple pixel components 430, 530 based on the plurality of position values, and further, the one or more marking devices may include a color element or may be a colored marking. As such, the instruction may direct application of certain colors to certain individual pixel components that may create a pixel artwork.

Other embodiments include a system for creating pixel artwork. The system for creating pixel artwork may include a sidewalk chalk stencil, an instruction, and a plurality of marking devices. Embodiments of the system may include any combination of these components and their respective aspects and features. The sidewalk chalk stencil may be configured for generating a pixelated grid formed by a plurality of pixel components on a surface of a substrate, and the sidewalk chalk stencil may include any of the stencils 100, 200, 300 or any of their respective features. The instruction may be configured to designate a position value to each pixel component of the plurality of pixel components based on a location of the each pixel component within the pixelated grid. The plurality of marking devices may be configured to transfer one or more markings to the surface of the substrate and may be associated with one or more the position values.

In even other embodiments, a pixel art kit may include a sidewalk chalk stencil and a plurality of marking devices. The sidewalk chalk stencil may include a plurality of apertures that have an orientation, and the sidewalk chalk stencil may be repositionable on a surface of a substrate. It is contemplated that the sidewalk chalk stencil may include any of the stencils 100, 200, 300 or any of their respective features. The plurality of marking devices may be configured to transfer a marking onto the surface of the substrate. In some aspects, the pixel art kit may include an instruction as previously discussed herein. The instruction may include a plurality of pixel color indicators associated with each of the multiple pixel components and may be configured to direct application of a marking device to a set of one or more position values on the surface of the substrate (e.g., a color by number concept). Further, the instruction may be further configured to direct application of an additional marking to an additional set of one or more position values on the surface of the substrate to create a pixel artwork according to a pattern of the instruction.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. A stencil for sidewalk chalk comprising:

a planar body presenting a first surface and an opposite second surface; and a plurality of apertures extending through the planar body, the plurality of apertures comprising an orientation, wherein the stencil is repositionable atop a surface of a substrate and the orientation of the plurality of apertures corresponds to multiple sets of pixel components that form a pixelated grid.

2. The stencil of claim 1, wherein the orientation of the plurality of apertures comprises an arrangement selected from the following:

a) a cube arrangement;

b) a hexagon arrangement; or c) a staggered brick arrangement.

3. The stencil of claim 1, wherein the plurality of apertures are configured to guide application of a marking device onto the surface of the substrate positioned below and adjacent to the second surface of the planar body.

4. The stencil of claim 3, wherein the marking device comprises a sidewalk chalk.

5. The stencil of claim 3, wherein the marking device comprises a powder chalk.

6. The stencil of claim 1, wherein the plurality of apertures define a border of each pixel component of the multiple pixel components.

7. The stencil of claim 6, wherein the borders of the multiple pixel components correspond to the orientation of the plurality of apertures and define the pixelated grid on the surface of the substrate.

8. A system for creating pixel artwork comprising:

a sidewalk chalk stencil comprising a plurality of apertures that correspond to a plurality of pixel components that form a pixelated grid on a surface of a substrate;

an instruction configured to designate a position value to each pixel component of the plurality of pixel components based on a location of the each pixel component within the pixelated grid; and a plurality of marking devices configured to transfer one or more markings to the surface of the substrate, wherein one or more of the plurality of marking devices are associated with one or more of the position values.

9. The system for creating pixel artwork of claim 8, wherein the sidewalk chalk stencil is (a) repositionable atop the surface of the substrate and (b) comprises a plurality of apertures configured to guide application of one or more of the marking devices to the surface of the substrate positioned below the sidewalk chalk stencil.

10. The system for creating pixel artwork of claim 8, wherein the plurality of apertures comprises an orientation and application of the one or more marking devices to the surface of the substrate positioned below the sidewalk chalk stencil defines a border of one or more pixel components of the plurality of pixel components.

11. The system for creating pixel artwork of claim 10, wherein the orientation of the plurality of apertures comprises an arrangement selected from the following:

a) a cube arrangement;

b) a hexagon arrangement; or c) a staggered brick arrangement.

12. The system for creating pixel artwork of claim 8, wherein the one or more marking devices associated with one or more of the position values comprise a corresponding coloring element.

13. The system for creating pixel artwork of claim 12, wherein application of the one or more marking devices to the surface of the substrate at each associated pixel component of the plurality of pixel components creates a pixel artwork on the surface of the substrate.

14. A pixel artwork kit comprising:

a sidewalk chalk stencil comprising a plurality of apertures having an orientation, wherein the plurality of apertures correspond to a border of a plurality of pixel components that form a pixelated grid on a surface of a substrate, wherein the sidewalk chalk stencil is repositionable on the surface of the substrate; and a plurality of chalk marking devices configured to transfer a marking onto the surface of the substrate.

15. The pixel art kit of claim 14, wherein the plurality of apertures of the sidewalk chalk stencil correspond to multiple pixelated components that form a pixelated gird on the surface of the substrate positioned below the sidewalk chalk stencil.

16. The pixel art kit of claim 14, wherein the plurality of chalk marking devices comprises a first chalk marking device of a first color and a second chalk marking device of a second color.

17. The pixel art kit of claim 16, wherein application of the first chalk marking device to the surface of the substrate at a first set of pixel components and application of the second chalk marking device to the surface of the substrate at a second set of pixel components creates a first pixel artwork.

18. The pixel art kit of claim 14, further comprising a first instruction comprising a plurality of pixel color indicators associated with each of the multiple pixel components.

19. The pixel art kit of claim 18, wherein the first instruction is configured to direct application of a first chalk marking to a first set of one or more position values on the surface of the substrate, and wherein the first instruction is further configured to direct application of a second chalk marking to a second set of one or more position values on the surface of the substrate to create a first pixel artwork according to a pattern of the first instruction.

20. The pixel art kit of claim 18, further comprising a second instruction comprising a plurality of pixel color indicators associated with each of the multiple pixel components, wherein the second instruction is configured to direct application of a third chalk marking to a third set of one or more position values on the surface of the substrate, and wherein the second instruction is further configured to direct application of a fourth chalk marking to a fourth set of one or more position values on the surface of the substrate to create a second pixel artwork according to a pattern of the second instruction.

* * * * *